United States Patent [19]

Carroll

[11] Patent Number: 5,005,886

[45] Date of Patent: Apr. 9, 1991

[54] LATCH MECHANISMS

[76] Inventor: Terence J. Carroll, 3 Lackenheath Court, Dingley, Victoria, Australia, 3172

[21] Appl. No.: 447,136

[22] Filed: Dec. 8, 1989

[51] Int. Cl.[5] ..... E05C 1/16

[52] U.S. Cl. ..... 292/336.3; 292/169.17

[58] Field of Search ..... 292/336.3, 169 R, 169.21, 292/169.22, 169.16, 140, DIG. 57

[56] References Cited

U.S. PATENT DOCUMENTS

| | | | |
|---|---|---|---|
| 1,080,687 | 12/1913 | Giese et al. | 292/169.22 |
| 1,391,114 | 9/1921 | Huber | 292/169 |
| 1,588,899 | 6/1926 | McCarthy | 292/169 X |
| 2,609,224 | 9/1952 | Mitchell | 292/169.16 |
| 3,544,147 | 12/1970 | James | 292/169 |
| 3,773,370 | 11/1973 | Jerila | 292/359 X |

*Primary Examiner*—Richard E. Moore

*Attorney, Agent, or Firm*—Fleit, Jacobson, Cohn, Price, Holman & Stern

[57] ABSTRACT

A latch bolt assembly and a locking device for use in a latch mechanism which can be fitted to a door or the like. The latch bolt assembly includes a casing and a bolt device which is receivable within a guide passage in the casing for movement between latched and retracted positions. A biasing spring is disposed between co-operating stops on the casing and the bolt device so as to normally urge the bolt device towards the latched position. The locking device comprises a locking element movable between a lock position and a release position and a control member which controls movement of the locking element and an actuating member which causes movement of the control member.

9 Claims, 2 Drawing Sheets

FIG. 1
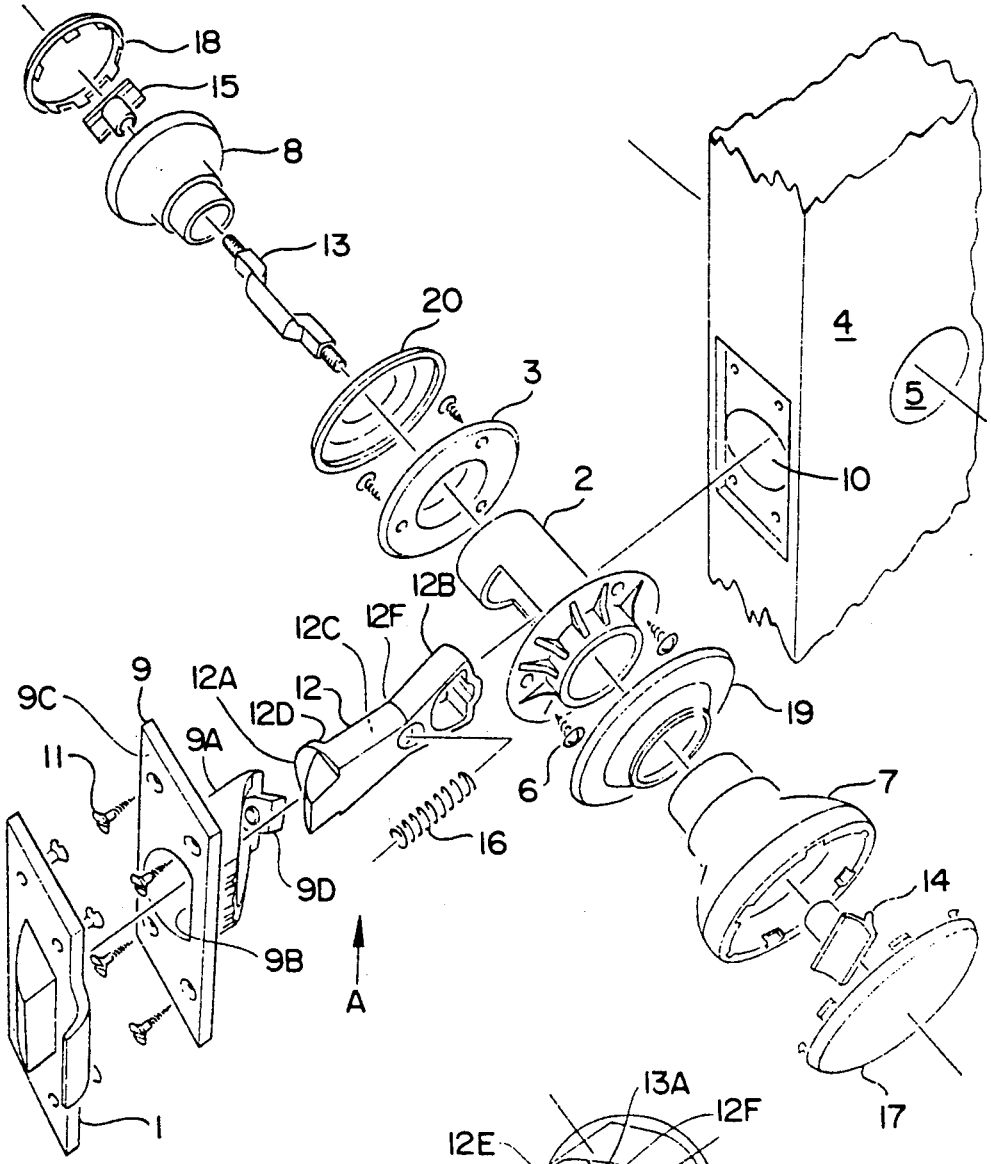
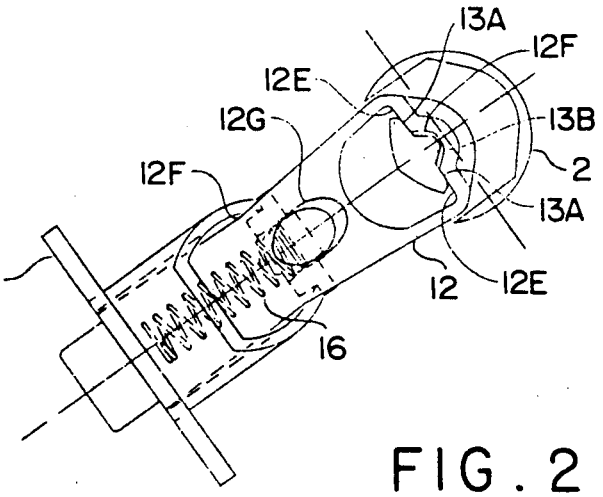
FIG. 2

LATCH MECHANISMS

This invention relates generally to latch mechanisms and improvements therein.

The latch mechanism of the present invention may be adapted to be mounted in an assembled position to a door or other closure. To this end, as is conventional, the door may include a first bore therein extending between opposite major side walls thereof and a second bore extending from a side edge of the door to the first bore. A striker plate may be provided on a section of a door frame surrounding the door the striker plate being adjacent the second bore.

Currently known latch mechanisms are relatively complicated mechanisms which are expensive to manufacture and difficult to maintain. Furthermore, the various components have almost always been formed from metal.

It is an object of the present invention to provide an improved latch mechanism and parts for use therein which is relatively uncomplicated and is suited for manufacture from substantially all plastics material.

According to one aspect of the present invention there is provided a latch bolt assembly for use in a latch mechanism the latch mechanism including an actuator for operating the latch bolt assembly; the latch bolt assembly comprising; a casing having a guide passage therein with openings at each end of the guide passage and a central axis extending between the openings; a bolt device including a head section with a tongue and a control section, at least part of the bolt device being receivable within the guide passage for movement therein in the direction of the central axis between a latched position and a retracted position. The control section is operatively connectible to the actuator of the latch mechanism so that operation of the actuator causes movement of the bolt device in the guide passage. The assembly further includes biasing means disposed between co-operating stops on the casing and on the bolt device such that in an operating position the biasing means normally urges the bolt device towards the latched position.

In the assembled position, the casing of the latch bolt assembly is fitted to the door so that at least part thereof is disposed within the second bore with the recess being generally axially aligned with the axis of the second bore. The bolt device is movable relative thereto in the recess so that in the latched position the tongue is capable of being located adjacent the striker plate so as to inhibit opening of the door. In the retracted position, the tongue is clear of the striker plate so that the door can be opened. The actuator is at least partially disposed within the first bore and operatively connected to the bolt device so as to cause movement thereof.

Preferably the casing and the bolt device include co-operating regions which together form a housing which retains the biasing means captive in the operating position. The co-operating regions preferably include a recess disposed in one of or both the casing and the bolt device so as to define the housing for the biasing means. In one preferred form, a recess is provided in the bolt device the other part of the housing being defined bY an internal wall surface of the guide passage. Preferably, the stop on the casing comprise a flange projecting into the recess in the bolt device the stop on the bolt device being defined by an end wall of the recess therein.

The head section of the bolt device may be generally complementary in cross-sectional shape to that of the guide passage. Preferably the internal wall of the guide passage is tapered inwardly towards the end adjacent the striker plate.

The biasing means may be in the form of a compression spring means such as a helical compression spring.

An access aperture may be provided in the wall of the bolt device opposite to the recess and extending into the recess which facilitates mounting of the biasing means in the operating position. The axis of this aperture is preferably inclined toward one end of the recess so that when the bolt device is disposed within the guide passage the biasing means can be passed through the aperture and correctly positioned within the housing in the operating position.

The actuator of the latch mechanism may be in the form of a rotatable shaft operatively connected to the control section of the bolt device so that rotation of the actuator shaft causes movement of the bolt device between the latched and retracted position. As mentioned above, the actuator when in the assembled position is at least partially disposed within the first bore for rotation therein. The actuator shaft may be operatively connected to one or more operating handles by which the actuator can be rotated.

Preferably the control section of the bolt device comprises at least one cam reaction surface which is engageable by a co-operating cam member on the actuator. The cam member and cam surface are preferably configured so that the cam member rolls along the cam reaction surface. Preferably two cam members are provided on the actuator shaft each being associated with a respective reaction surface the arrangement being such that rotation of the actuator shaft in either direction causes movement of the bolt device from the latch to the retracted position and the biasing means tends to return the bolt device to the latched position.

In one preferred form, the control section comprises an aperture in an end portion of the bolt device remote from the head section the aperture having an end wall the inner surface of which defines the cam reaction surfaces. Preferably the end wall includes a notch therein for receiving a complementary rib on the actuator shaft with the cam members being disposed on opposite sides of the rib. Preferably the biasing means urges the cam member and associated reaction surface into engagement with one another.

In one form of the invention, the casing may comprise a tubular section having the guide passage therein and a mounting plate at one end of the tubular section which is adapted to be secured to the side edge of the door with the tubular section projecting into the second bore. The bolt device is disposed within the passage with its control section extending into the first bore and the actuator shaft extends axially of the first bore between the two opposed sides of the door.

The latch mechanism may further include a support housing to which the operating handles may be mounted. The support housing may include a tubular section which extends through the first bore in the door and a flange which is adapted to be secured to the door so as to hold the support in place. Preferably a portion of the internal wall surface of the tubular section forms a bearing surface for the handles which preferably are in the form of rotatable knobs. The actuator shaft is adapted to extend through the tubular section of the support and is operatively connected at each end to a respective handle. An aperture may be provided in the wall of the tubular section of the support provides for operative connection between the latch bolt assembly and the actuator.

Preferably all of the parts referred to above with the exception of the biasing means are formed from a suitable plastics material although it will be appreciated that other materials could be used.

According to another aspect of the present invention there is provided a locking device for a latch mechanism, the latch mechanism including a bolt device movable between the latched and retracted positions, an actuator shaft operatively connected to the bolt device such that rotation thereof about an axis of rotation causes movement of the bolt device between the latched and retracted position and at least one operating handle operatively connected to the actuator shaft by which the actuator shaft can be rotated. The bolt device may be in the form of the latch bolt assembly described above although it could take other forms. Basically, the locking device of the invention comprises a locking element which is mounted for movement in the direction of the axis of the actuator shaft between a lock position in which rotation of the actuator shaft by the handle is inhibited and a release position in which the actuator shaft can be rotated by the or each operating handle. The locking device further includes a control member operatively connected to or engageable with the locking element, the control member being mounted for movement in the direction of the axis of the actuator shaft between the first and second positions whereby in said first position the locking element is caused to adopt the lock position and in the second position the locking element can adopt the release position. The arrangement is such that when in the first position, the control member is capable of rotational movement and in the second position it is inhibited from such rotational movement. The locking device further includes an actuating member operable to cause the axial movement of the control member and drive means associated with the actuating member and the control member for causing rotation of the control member when in the first position.

Preferably the locking device further includes a mounting body operatively connected to the actuator shaft the mounting body being adapted to support at least part of the locking element and the control member and permit axial movement therealong in the direction of the axis of the actuator shaft. The mounting body preferably operatively connects the actuator shaft to the handle and may comprise a tubular or rod like member operatively connected to one end of the actuator shaft.

In one form, the locking element may comprise a first part which includes one or more segments which, in the lock position, are adapted to engage a stop which may be formed on the door or on the support housing of the latch mechanism described earlier to inhibit rotation of the actuator shaft the first part further including a pair of arms which are operatively connected to a second part which comprises a ring-like element slidable along the mounting body.

The control member may be in the form of an annular disc-like element receivable on the mounting body for movement therealong in the axial direction. The disc element is adapted to engage the ring-like element of the locking element so that axial movement thereof causes movement of the locking element between the release position to the locking position.

Preferably the drive means comprises a plurality of ratchet elements on the disc-like member engageable by projections on the actuator. The actuator preferably comprises a manually depressible button and is arranged such that by depressing the button the projections engage the ratchet elements so that when the locking member is in the lock position the control member is capable of being rotated. Means is provided for inhibiting the rotation of the control member by the drive means when the locking element is in the release position. Such means may be in the form of one or more axially extending ribs which are adapted to co-operate with apertures in the control member thereby preventing relative rotation between the two parts.

Biasing means may be provided for urging the locking element into the release position. The biasing means may be in the form of a helical spring adapted to act on the second part of the locking element.

The operation of the preferred form of the locking device is as follows. When the actuator button is depressed it causes the disc-like control member to move axially along the mounting body thereby moving the locking element into the lock position. In this initial movement the control member is inhibited from rotation because of the ribs on the mounting body.

When the control member clears the ribs the ratchet element and projections co-operate to cause a limited rotation of the control member so that the apertures are offset from the ribs and as such the control member is prevented from returning under the influence of the biasing spring. In this position, the locking element is in the lock position and rotation of the actuator shaft is inhibited.

Further depression of the button causes the projections and ratchets to co-operate to cause a further partial rotation so that the apertures and ribs are aligned thereby enabling the control member and the locking element to be axially moved into the release position.

Preferred embodiments of the invention will be hereinafter described with reference to the accompanying drawings and in those drawings:

FIG. 1 is an exploded isometric view showing one form of latch mechanism according to the invention;

FIG. 2 is a sectional side elevation showing the latch bolt assembly according to the present invention.

Figure 3:
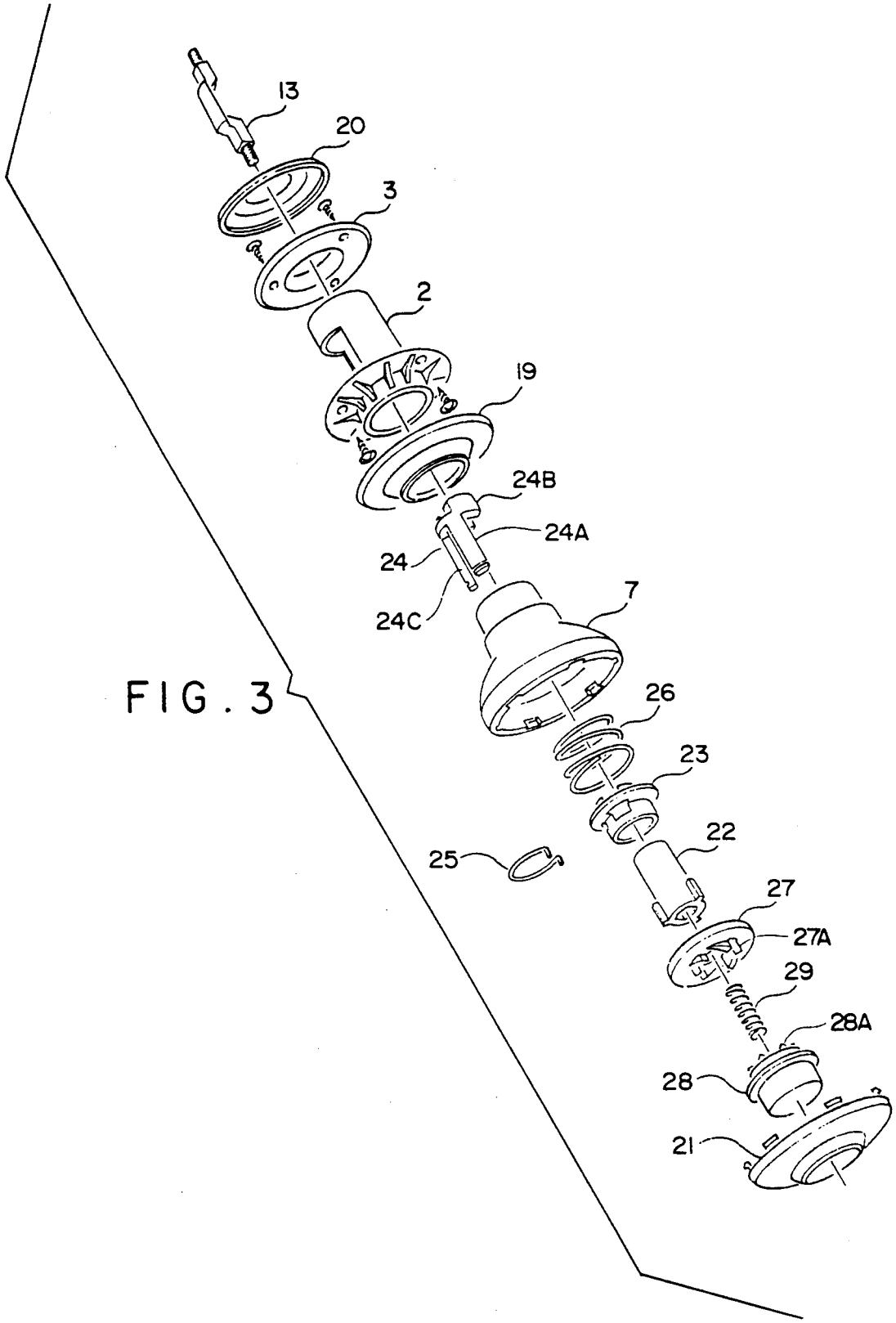
FIG. 3 is an exploded isometric view showing the latch mechanism including the locking device according to the present invention.

Referring to the drawings, the latch mechanism generally indicated at A is adapted to be mounted to a door 4 having a first bore 5 therein and a second bore 10 which extends through to the first bore 5. A striker plate 1 is provided as is conventional.

The latch mechanism A includes a latch bolt assembly comprising a casing 9 comprising a tubular section 9A having a guide passage 9B therein and a face plate 9C by which the casing is secured to the side edge of the door by means of screws 11 the tubular section 9A extending into a second bore 10 in the door 4. The latch bolt assembly further includes a bolt device 12 having a head section 12A and a control section 12B, Biasing means in the form of a compression spring 16 is disposed within a recess 12C in the bolt device 12 the compression spring 16 extending between stops 9D and 12D. The spring 16 can be mounted within the recess 12C via access aperture 12G.

The control section 12B of bolt device 12 includes a pair of cam reaction surfaces or pads 12E having a locating slot 12F therebetween. The control section 12B of the bolt device 12 is disposed within the first bore 5.

An actuator in the form of an actuator shaft 13 extends through the first bore 5 and is operatively connected to operator handles in the form of knobs 7 and 8 by means of wing nuts 14 and 15. The actuator shaft 13 includes cam sections 13A which engage against pads 12E. A centering rib 13B is disposed within slot 12F.

The compression spring 16 operates between the stops 9D and 12D on the casing and bolt device exerting a force on the bolt device such that continuous contact is achieved between the bolt device and the cams of the actuator shaft 13 so that engagement of the bolt device to the striker plate is assured.

The cams of the actuator shaft 13 are symmetrical but offset to the shaft/center line axis. The cams of the shaft bear on the inner pads of the bolt device in such a way that rotation of the cam shaft in either direction causes either the upper or lower cam to retract the bolt device.

To open the door clockwise or anti-clockwise, rotation is applied to either knob 7 or 8 thus causing the bolt device to be retracted by rotation action of the shaft 13 and is guided in the linear direction by the casing 9 thereby disengaging from the striker plate 1.

Upon releasing door knob 7 or 8 and closing the door, compression spring 16 provides the necessary tension to return the system to its original position automatically with the tongue of the bolt device re-engaging the striker plates and both cams of the shaft being returned to full contact with the inner pads of the bolt assembly.

Fascias 17 and 18 serve to cover the nut attachment of knobs 7 and 8 and to present a smooth appearance when fitted to the knobs. Fascias 17 and 18 are retained to knobs 7 and 8 by means of a series of tongues which are moulded integral with the fascias and which register in and snap into matching openings in knobs 7 and 8 so as to be firmly retained.

Escutcheons 19 and 20 are provided for decorative purposes only and are arranged as a snap-on fitting to support 2 and flange 3.

A support housing 2 is mounted within the first bore 5 and held in position by means of flange 3 and a flange on the support housing 2. The support housing 2 provides a bearing surface for the operating knobs 7 and 8.

The locking device which comprises a separate aspect of the present invention is shown in more detail in FIG. 3. The locking device includes a locking element 24 which is mounted for movement in the axial direction of the axis of the actuator shaft between a locked position in which rotation of the actuation shaft by the operator handles is inhibited in a release position in which the actuator shaft can be rotated. The locking element 24 includes a first part 24A in the form of a yoke having at one end two segments 24B. The segments can act between the shaft 3 and the support housing 2 to prevent rotation of the shaft. At the opposite end of the first part 24A there are two arms or probes 24C which are a free sliding fit in matching openings in the knob and extend through so as to be secured to a second part 23 which is in the form of a ferrule or ring-like element which is slidably mounted on a mounting body 22.

The mounting body 22 is in the form of a tubular member which is used to secure the cam shaft to the operating knob. The body 22 has a series of ribs 22A at one end thereof for reasons which will become apparent.

The support housing 2 possesses a raised rib (not shown) within its internal diameter, this rib being positioned such that contact by one or both of the segments 24B of yoke 24A prevent rotation of yoke 24A and also prevent rotation of the shaft 3 rendering the mechanism locked.

Spring 26 provides the force necessary to hold yoke 24A out of contact with support housing 2 for normal operation of the latch mechanism; ie the locking element is in the release position.

Ferrule 23 and yoke 24A act as one unit ie the locking element which can be made to slide into engagement or disengagement with the rib within the support housing 2 to lock or unlock the latch mechanism. The control member comprises an annular disc-like member 27 receivable on the tubular mounting body 22 for movement thereon. Drive means in the form of a ratchet 27A is provided on disc 27. The disc 27 has a circular but notched opening at its middle which matches the ribs 22A at the end of the tubular nut 22. Ratchet 27 is allowed to slide freely on the tubular nut 23 but rotation is prevented by the longitudinal ribs 22A thereon.

Actuator button 28 is cylindrical in form whose inner opening matches the ribbed end of the tubular nut 22 is in free sliding fit on the nut. Rotation of the button 28 is prevented by the longitudinal ribs.

The device means further comprises a set of teeth 28A on button 28. In the normal unlocked condition, continuous contact exists between the teeth and ratchet and the teeth on the button 28.

When button 28 is depressed and made to move along the tubular nut 22 control member 27 is also forced to move and carry before it ferrule 23 which in turn causes yoke 24A to engage with the rib within the support housing 2 and lock the latch mechanism.

The ratchet on the control member and the teeth 28A on the button 28 are so arranged that when button 28 is depressed and control member 27 is caused to slide and pass the end of the ribs 22A and thereby partial rotation of the control member 27 takes place as a result of the interengagement of ratchet elements 27A and teeth 28A. The control member 27 is thereby retained in this position by the longitudinal ribs 22A of the tubular nut 22 thus ensuring that the yoke is retained in the locked position.

Spring 29 is provided to return button 28 to its original position.

To unlock the system, the button is again depressed causing tooth contact with ratchet 27A. The tooth form again causes partial rotation of control member 27 allowing the holes in control member 27 to once more align with the longitudinal ribs of tubular nut 22 and become free to slide. Spring 26 then provides the force necessary to disengage yoke 24 from the rib within the support 2 and return yoke 24, ferrule 23 and control member 27 to the original unlocked position.

Fascia 21 is similar to previouslY described fascia 17, except that an opening is provided for access to button 28. The shape of button 28 is such that it will not pass through the opening in fascia 21.

Finally it is to be understood that various alterations, modifications and/or additions may be incorporated into the various constructions and arrangements of parts without departing from the spirit and ambit of the invention.

We claim:

1. A locking device for a latch mechanism, the latch mechanism including a bolt device movable between a latched position and retracted position, an actuator shaft operatively connected to the bolt device such that rotation thereof about an axis of rotation causes movement of the belt device between the latched and retracted positions and at least one handle operatively connected to the actuator shaft by which the actuator shaft can be rotated, the locking device comprising:

a locking element mounted for movement in the direction of the axis of the actuator shaft between a lock position in which rotation of the actuator shaft by the handle is inhibited and a release position in which the actuator can be rotated by the handle;

a control member operatively connected to or engageable with said locking element said control member being mounted for movement in the direction of the actuator shaft between first and second positions whereby in said first position the locking element is caused to adopt the lock position and in said second position the locking element can adopt the release position, whereby in said first position the control member is capable of rotatable movement and in said second position is inhibited from that rotational movement; and an actuating member operable to cause the axial movement of the control member and drive means associated with said actuating member and said control member for causing rotation of the control member when in the first position.

2. A locking device according to claim 1 further including a support body operatively connected to the actuator shaft said support body being adapted to support at least part of said locking element and said control member and permit movement therealong in the direction of the axis of the actuator shaft.

3. A locking device according to claim 2 wherein said support body operatively connects said actuator shaft to said handle.

4. A locking device according to claim 3 wherein said support body comprises a tubular or rod like member operatively connected to one end of the actuator shaft.

5. A locking device according to claim 1 wherein said locking element includes a first part which includes one or more segments which in the lock position adapted to engage a stop to inhibit rotation of the actuator shaft and a pair of arms which are operatively connected to a second part which comprises a ring like element slidable along the support body.

6. A locking device according to claim 1 wherein said control member comprises an annular disc-like member receivable on the support body for movement therealong.

7. A locking device according to claim 6 wherein said drive means comprises a plurality of ratchet elements and the disc-like member engageable by projections on said actuator.

8. A locking device according to claim 1 wherein said actuator comprises a manually depressible button.

9. A locking device according to claim 1 further including biasing means urging said locking element into said release position.

* * * * *